US006324792B1

(12) United States Patent
DeGarie

(10) Patent No.: US 6,324,792 B1
(45) Date of Patent: Dec. 4, 2001

(54) CIRCULAR CLARIFIER WITH RETRACTABLE COVER

(76) Inventor: Claude J. DeGarie, 1133 Regent Street, Suite 300, Fredericton, New Brunswick (CA), E3B 3Z2

( * ) Notice: Subject to any disclaimer, the term of this patent is extended or adjusted under 35 U.S.C. 154(b) by 0 days.

(21) Appl. No.: 09/666,081

(22) Filed: Sep. 21, 2000

(30) Foreign Application Priority Data

Nov. 19, 1999 (CA) ..... 2290226

(51) Int. Cl.[7] ..... E04B 1/32; E04B 1/342; E04B 7/08

(52) U.S. Cl. ..... 52/80.1; 52/82; 52/83; 403/217; 403/218

(58) Field of Search ..... 52/80.1, 80.2, 52/82, 83; 403/217, 218, 169, 52, 65, 64

(56) References Cited

U.S. PATENT DOCUMENTS

| | | | | |
|---|---|---|---|---|
| 481,347 | * | 8/1892 | Cunningham | 52/80.1 |
| 2,360,285 | * | 10/1944 | Sherman | 108/1 |
| 3,130,488 | * | 4/1964 | Lindstrom | 52/80.1 |
| 3,377,637 | * | 4/1968 | Zamorano | 14/24 |
| 3,683,427 | * | 8/1972 | Burkholz | 52/80.1 |
| 3,894,367 | * | 7/1975 | Yacoboni | 52/80 |
| 4,136,408 | * | 1/1979 | Dahlbeck | 4/172.12 |
| 4,256,300 | * | 3/1981 | Boucher | 403/65 |
| 4,400,927 | * | 8/1983 | Wolde-Tinase | 52/745 |
| 4,413,747 | * | 11/1983 | Tenold | 220/225 |
| 4,593,710 | * | 6/1986 | Stafford | 135/102 |
| 4,750,509 | * | 6/1988 | Kim | 135/102 |
| 4,951,327 | * | 8/1990 | Del Gorio, Sr. | 4/498 |
| 5,381,634 | * | 1/1995 | Pietrogrande | 52/86 |
| 5,943,709 | * | 8/1999 | Chiu | 4/506 |

* cited by examiner

*Primary Examiner*—Carl D. Friedman
*Assistant Examiner*—Chi Nguyen
(74) *Attorney, Agent, or Firm*—Mario Theriault

(57) ABSTRACT

The clarifier cover has a shape defined by a low profile circular segment of revolution around the central column of the clarifier, for maintaining the volume of gas thereunder minimum. In another aspect, the support structure of the cover is made of a plurality of ring trusses disposed in a circular array and defining a circle, concentric with the circular wall of the clarifier, and a radial array of outer trusses each having an outside end mounted to the wall of the clarifier and an inside end mounted to the plurality of ring trusses. A series of inner trusses are individually affixed in an overhung mode to one of the outer trusses, such that the loading applied to the central column of a clarifier by the cover structure is minimal or negligible. The trusses define an array of triangular frame sectors. A flexible sheet sector affixed to each frame sector, and at least one of the flexible sheet sectors has a retractable section which is removably affixed to one of the triangular frame sectors and to the clarifier wall.

21 Claims, 10 Drawing Sheets

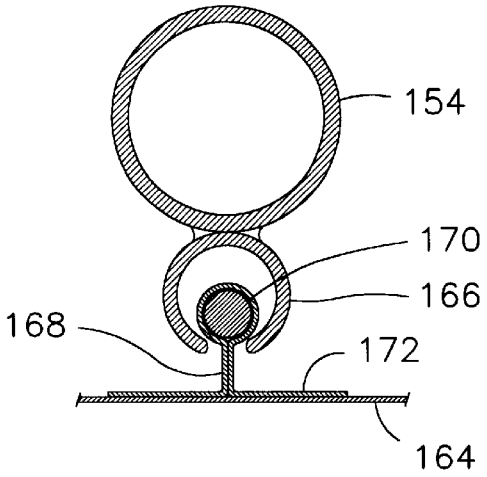
FIG. 22
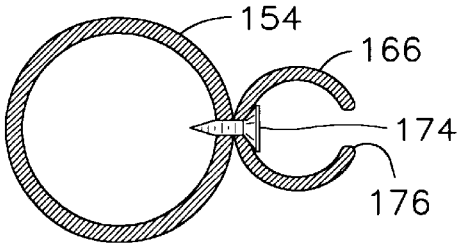
FIG. 23
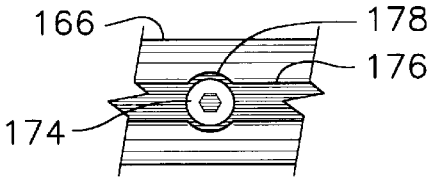
FIG. 24
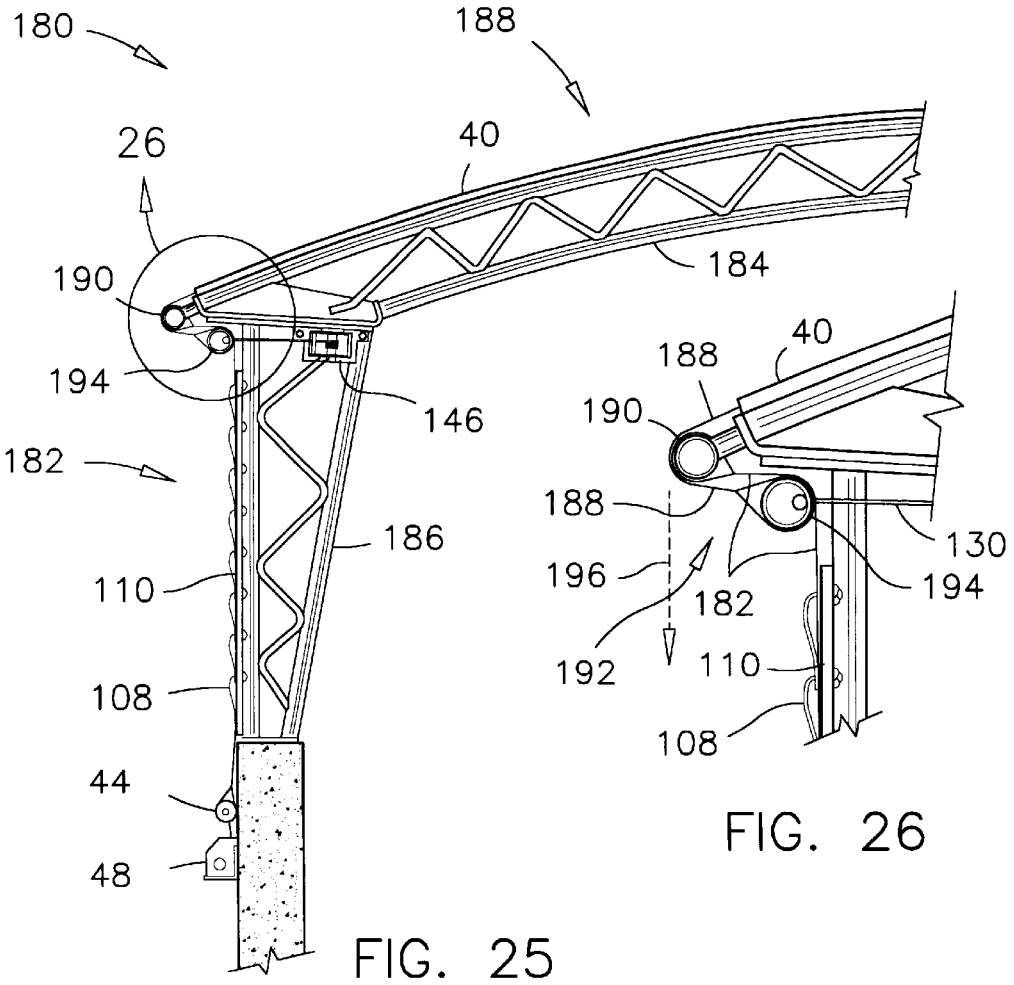
FIG. 26
FIG. 25

CIRCULAR CLARIFIER WITH RETRACTABLE COVER

FIELD OF THE INVENTION

This invention pertains to covered clarifiers, and more particularly, the present invention pertains to a low profile retractable cover which is supported largely on the outside wall of a circular clarifier.

BACKGROUND OF THE INVENTION

The clarification of industrial effluent is normally effected by alternatively agitating and letting the effluent settle, and lifting floating scum from the surface of the effluent or scraping sediments at the bottom of the reservoir. The clarification process is often accompanied by a fermenting action and a generation of odorous bio-gases, and/or the release of volatile organic carbons. For environmental reasons, these gases must be collected and treated. Therefore, a clarification reservoir, or clarifier, is preferably covered and sealed to contain the off-gases. Also, a clarifier preferably has a piping system to transport the off-gases to a gas treatment plant.

An industrial clarifier is often circular in shape. The reservoir typically has a central column supporting a motor, a gearbox, and a bearing assembly carrying a surface-skimming boom, a bottom rake or both. These equipment must be accessible for inspection, repair or preventive maintenance. Therefore a first preferred feature of a clarifier cover consists in its ability to be opened, to inspect, repair or maintain the boom, the rake, the circumferential launder or other equipment inside the reservoir. A second preferred feature is that the cover must be adaptable to the integration of a catwalk to the central column, to allow access to the machinery on the central column at all times.

The covering of a clarifier is often associated with the implementation of environmental regulations. Therefore a cover is often installed on an existing clarifier which was not designed to support a cover structure. Therefore, the retrofit installation of a cover over an existing clarifier must be done in such a way that the cover does not apply a substantial load or side stress on the central column inside the clarifier.

Another preferred feature in a clarifier cover is that the enclosed volume above the level of the clarifier must be kept as small as possible to maintain the ventilation of the clarifier as efficient and as economically as possible.

Examples of various systems available for covering a reservoir are described in the following documents:

U.S. Pat. No. 3,130,488 issued on Apr. 28, 1964 to G. Lindström;

U.S. Pat. No. 3,683,427 issued on Aug. 15, 1972 to H. C. Burkholz et al.;

U.S. Pat. No. 4,136,408 issued on Jan. 30, 1979 to E. L. Dahlbeck et al.;

U.S. Pat. No. 4,400,927 issued on Aug. 30, 1983 to A. M. Wolde-Tinase;

U.S. Pat. No. 4,951,327 issued on Aug. 28, 1990 to V. J. Del Gorio, Sr.;

U.S. Pat. No. 5,381,634 issued on Jan. 17, 1995 to S. Pietrogrande et al;

U.S. Pat. No. 5,943,709 issued on Aug. 31, 1999 to H. Y. Chiu;

Although the cover structures of the prior art deserve undeniable merits, it is believed that a need still exists in the industry for a clarifier cover which has a low profile, which does not apply substantial load on the central column of a clarifier, which is easily openable for inspection, repair or maintenance of the equipment inside the clarifier and which is strong and durable and can accommodate a catwalk to the central column.

SUMMARY OF THE INVENTION

In the present invention, there is provided a retractable clarifier cover which has a low profile, which is particularly appropriate for a retrofit installation over an existing clarifier, and which has all the other aforesaid advantages.

In a first aspect of the present invention, there is provided a clarifier cover having a plurality of saddle brackets mounted on the circular outside wall of the clarifier and a central ring plate mounted on the central column of the clarifier. A support structure is affixed to the saddle brackets and to the central ring plate, and a flexible sheet cover is affixed to the support structure. The support structure has a shape defined by a low profile circular segment of revolution around the central ring plate.

The shape of the support structure is particularly advantageous for defining a relatively small volume of gas under the cover, whereby the ventilation of the clarifier is doable economically. The shape of the support structure is also advantageous for isolating the mechanical and electrical equipment that may be present atop the central column of the clarifier from the corrosive or inflammable gases which may be generated inside the clarifier by the content of the clarifier.

In accordance with another aspect of the present invention, there is provided a support structure for supporting a flexible sheet cover over a circular clarifier. The support structure comprises a plurality of spaced-apart saddle brackets disposed in a first circular array defining a first circle. There is also provided a plurality of ring trusses disposed in a second circular array and defining a second circle, concentric with and inside the first circle. The support structure also comprises a radial array of outer trusses each having an outside end mounted to one of the saddle brackets and an inside end mounted to the plurality of ring trusses. A series of inner trusses are individually affixed to and extend from the inside end of one of the outer trusses, toward the centre of the first circle.

In this structural arrangement, the outer trusses and the ring trusses constitute a self-supporting structure wherein the weight thereof rests on the saddle brackets. The inner trusses are affixed to the outer trusses in an overhung mode such that the loading applied to the central column of a clarifier by the cover structure is minimal or negligible.

In yet another aspect of the present invention, there is provided a retractable cover mounted over a circular clarifier. The retractable cover comprises a central ring plate mounted on the central column of the clarifier; a plurality of saddle brackets affixed to the outside wall of the clarifier, and a support structure affixed to the support brackets and to the central ring plate. The support structure is made of an array of triangular frame sectors, each having an apex over the central column and a base over the outside wall of the clarifier, and a flexible sheet sector affixed thereto. At least one of the flexible sheet sectors has a retractable section near the base of the corresponding triangular frame sector. This retractable section is removably affixed to one of the triangular frame sector and to the clarifier wall. The clarifier cover according to the present invention is thereby selectively openable for inspection, repair or maintenance of equipment inside the clarifier.

Other advantages and novel features of the present invention will become apparent from the following detailed description.

BRIEF DESCRIPTION OF THE DRAWINGS

Four embodiments of this invention are illustrated in the accompanying drawings, in which like numerals denote like parts throughout the several views, and in which:

FIG. 22 is a cross-section view of an alternative arrangement for retaining the flexible sheet cover to the lower cord of a truss, as seen along line 22 in FIG. 21;

FIG. 23 is a cross-section of a slotted pipe affixed to one of the trusses of the claifier cover, illustrating a mounting arrangement using self-tapping screws;

FIG. 24 is a side view of the slotted pipe looking inside the slot thereof;

FIG. 25 is a partial cross-section view of a claifier cover according to a fourth preferred embodiment;

FIG. 26 is an enlarged partial view of the cornice and soffit of the clarifier cover according to the fourth preferred embodiment, as seen in the detail circle 26 in FIG. 25.

DETAILED DESCRIPTION OF THE PREFERRED EMBODIMENTS

Figure 1:
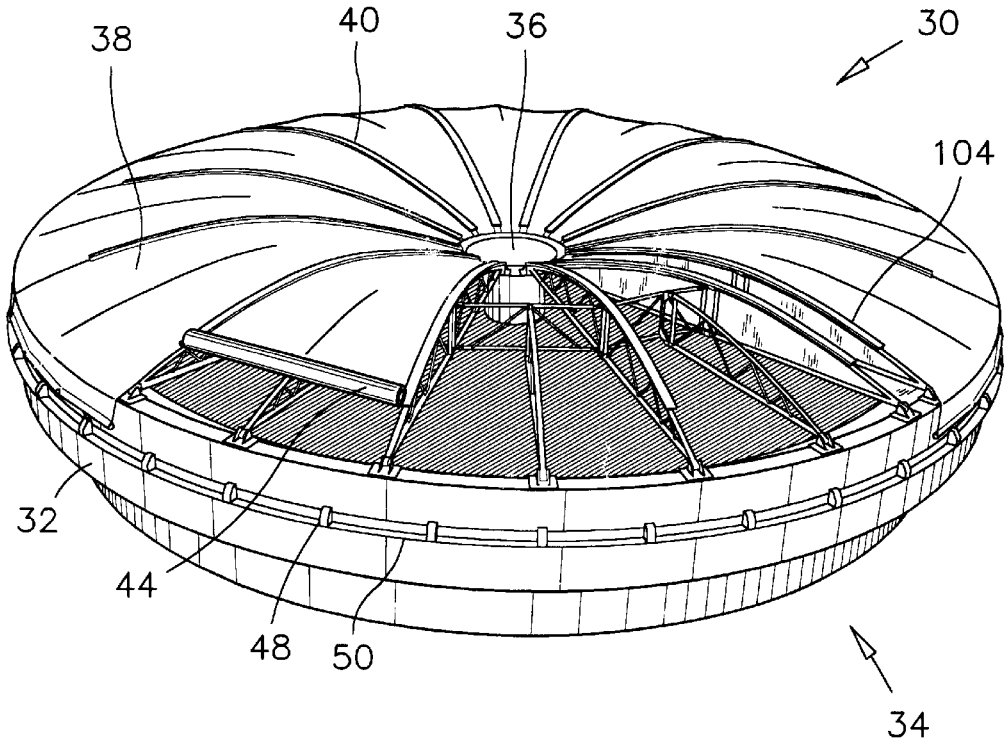
FIG. 1 is a perspective view of a circular clarifier having a retractable cover according to the first preferred embodiment of the present invention mounted thereon.
Figure 2:
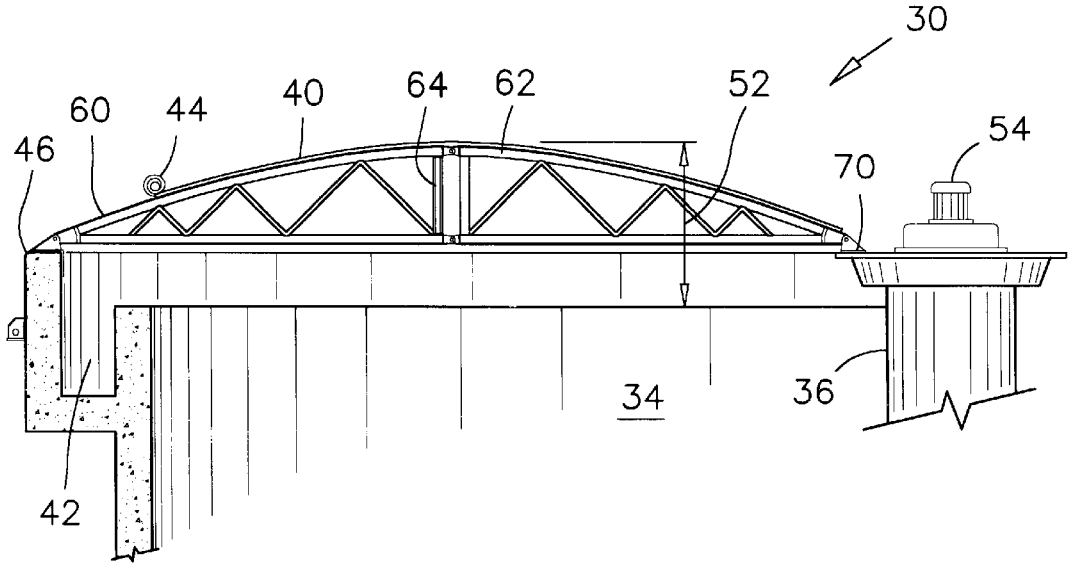
FIG. 2 is a cross-section view of the support structure of the retractable cover according to the first preferred embodiment, as seen along a radius thereof.

While this invention is susceptible of embodiments in many different forms, there are shown in the drawings and will be described in details herein four specific embodiments, with the understanding that the present disclosure is to be considered as an example of the principles of the invention and is not intended to limit the invention to the embodiments illustrated and described. The four embodiments do not differ substantially from one another but are nonetheless enclosed herein to better illustrate various manners of construction, installation and operation of the present invention The first preferred retractable cover 30 has the shape of a circular segment of revolution or of a half-bagel. The retractable cover structure 30 is made of trusses and flexible sheet sectors stretched over or under the trusses. The trusses are supported principally on the outside wall 32 of the clarifier 34, and are lightly anchored to the central column 36 inside the clarifier. Each flexible sheet sector 38 is made of a stretch-resistant nylon-based pliable sheet material. Each flexible sheet sector 38 is partially held to slotted rails 40, mounted over the trusses. In the first preferred installation, each flexible sheet sector has along each side edge thereof a hem and a rod or oblong nodules enclosed in the hem (not shown) and engaged in the slotted rail 40 as it is customary with tarpaulin structures. The slotted rails 40 do not extend to the edge of the clarifier, such that one or more sheet sectors 38 are retractable away from the clarifier wall 32 as shown in FIG. 1 for the purpose of inspecting the launder 42 or other equipment inside the clarifier. The retractable section of a sheet sector 38 is openable by winding it on a winding roll 44 as illustrated in FIGS. 1 and 2. In FIG. 1, two sheet sectors have been omitted from the drawing for the purpose of illustrating the support structure of the cover.

When the cover is in a closed and sealed mode, each sheet sector 38 is held tight over the edge 46 of the clarifier 34 by a series of pullers 48 mounted in a structural angle 50 which is affixed to the clarifier wall 32. A group of pullers 48 act upon the winding roll 44 of each sheet sector 38.

The retractable cover 30 according to the first preferred embodiment is advantageous for its low height, shown by label 52, between the maximum effluent level inside the clarifier and the inside surface of the flexible sheet 38. The space inside the clarifier is therefore relatively small as compared to a conical or a dome-shaped structure for example. The air changes required to ensure a good ventilation of the clarifier is therefore also relatively small, and the equipment required to do this is relatively simple and inexpensive.

The circular segment of revolution or the half-bagel shape of the cover is also advantageous for isolating the equipment 54 mounted over the central column 36 of a circular clarifier, from the corrosive or inflammable gases which may be generated by the content of the clarifier.

Figure 3:
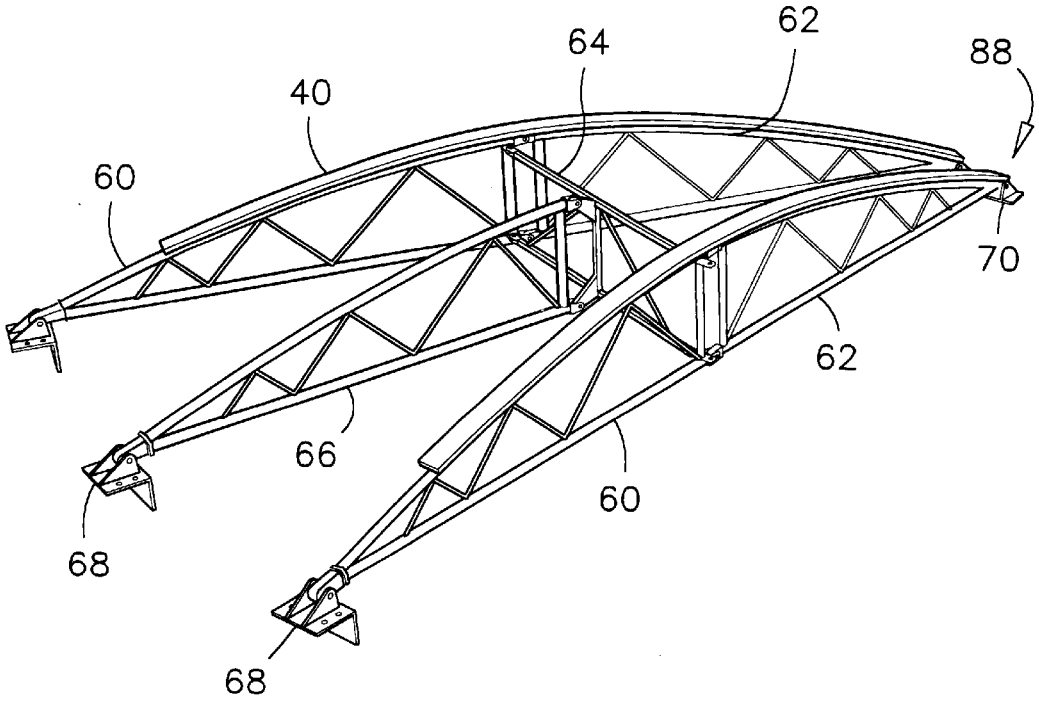
FIG. 3 is a perspective view of one of the triangular frame sectors of the support structure.
Figure 4:
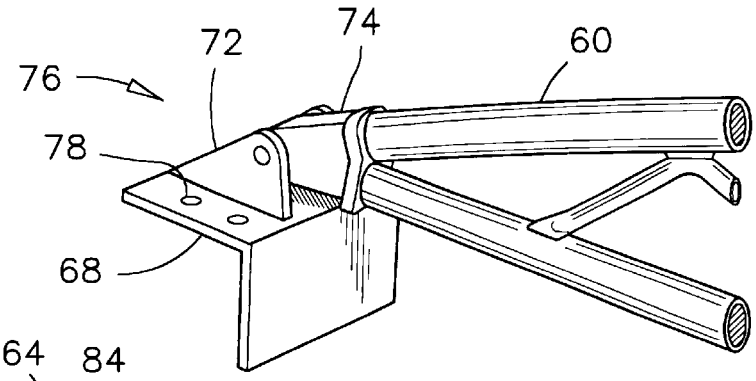
FIG. 4 is an enlarged partial perspective view of an outer truss and a saddle bracket supporting an outer truss on the clarifier wall.
Figure 5:
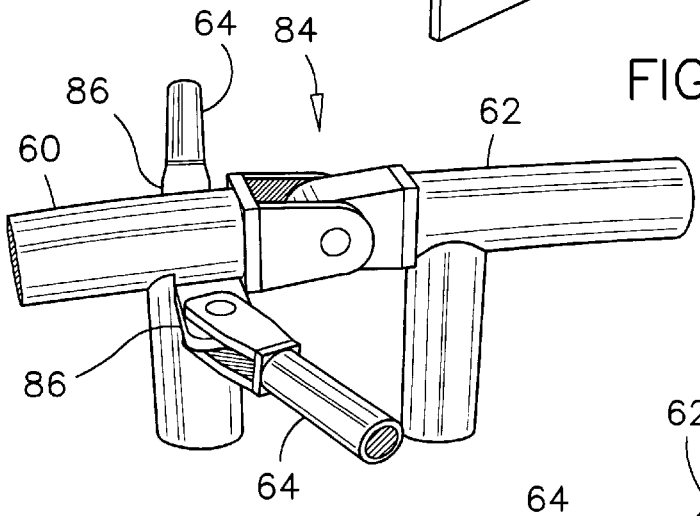
FIG. 5 is a partial perspective view of a connection between an outer truss and an inner truss and of a connection between an outer truss and a ring truss.

Referring now specifically to FIG. 3, the support structure comprises outer trusses 60, inner trusses 62 connected to the outer trusses, and ring trusses 64 extending laterally between the outer trusses 60. There are also provided intermediate trusses 66 extending radially outwardly relative to the centre of the support structure, from a mid span of each ring truss 66. The outer trusses 60 are supported on a series of saddle brackets 68 affixed to the outside wall 32 of the clarifier. The inner trusses 62 are supported primarily on the outer trusses 60 and are lightly anchored to a ring plate 70 affixed to the central column 36 of the clarifier.

FIGS. 4–8 illustrate various preferred connections between the trusses and the clarifier structure. The preferred saddle bracket 68 consists of an angle member with a pair of clevis plates 72 affixed to the upper portion thereof. Each outer truss 60 has a holed stem 74 adapted to connect to the clevis plates 72 with a bolt or a pin. This connection is referred to herein as the first clevis and stem connection 76. The saddle bracket 68 is anchored to the clarifier wall through holes 78 in the upper portion thereof.

Figure 7:
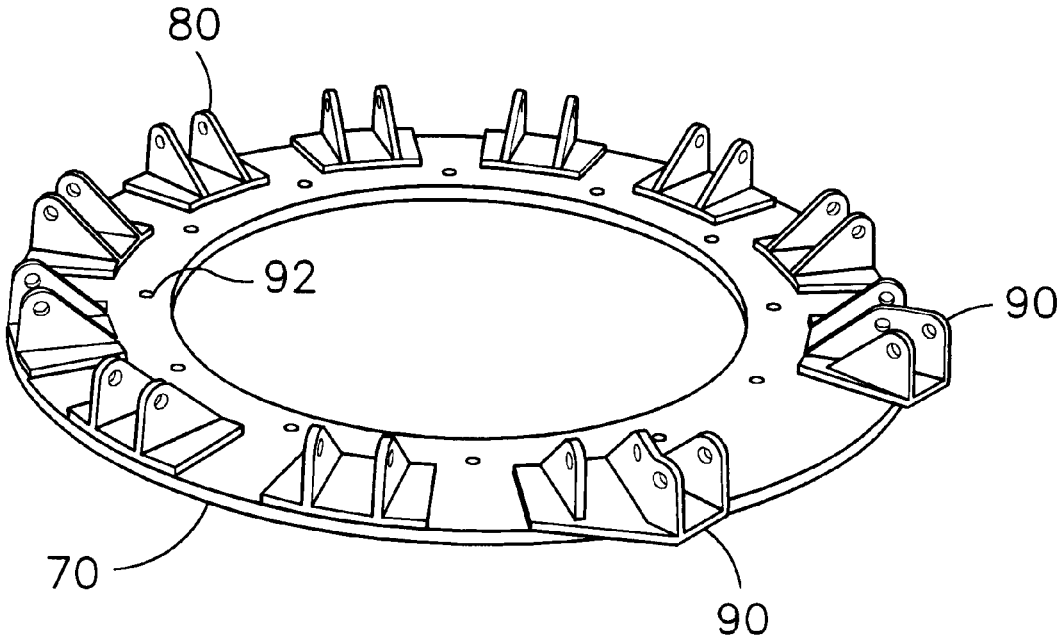
FIG. 7 is a perspective view of a ring plate for retaining the inner trusses of a support structure to the central column of a clarifier.
Figure 8:
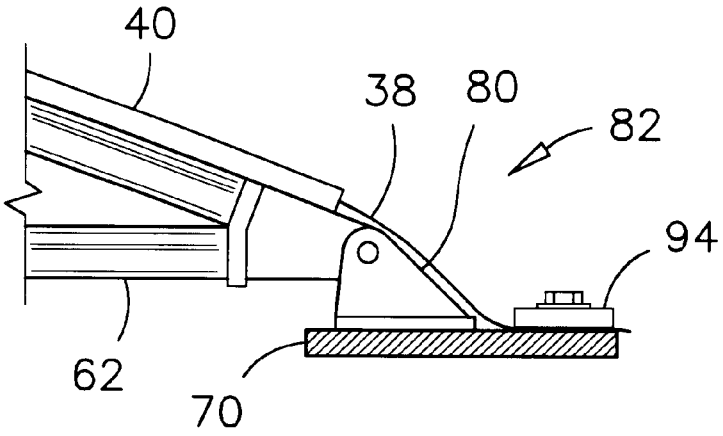
FIG. 8 a cross-section view through the ring plate, showing a preferred attachment of a flexible cover thereto.

The ring plate 70 is affixed to the central column 36 by conventional means, and has a number of clevis brackets 80 to make respectively a second clevis and stem connection 82 with one of the inner trusses 62, as shown in FIGS. 7 and 8.

Figure 6:
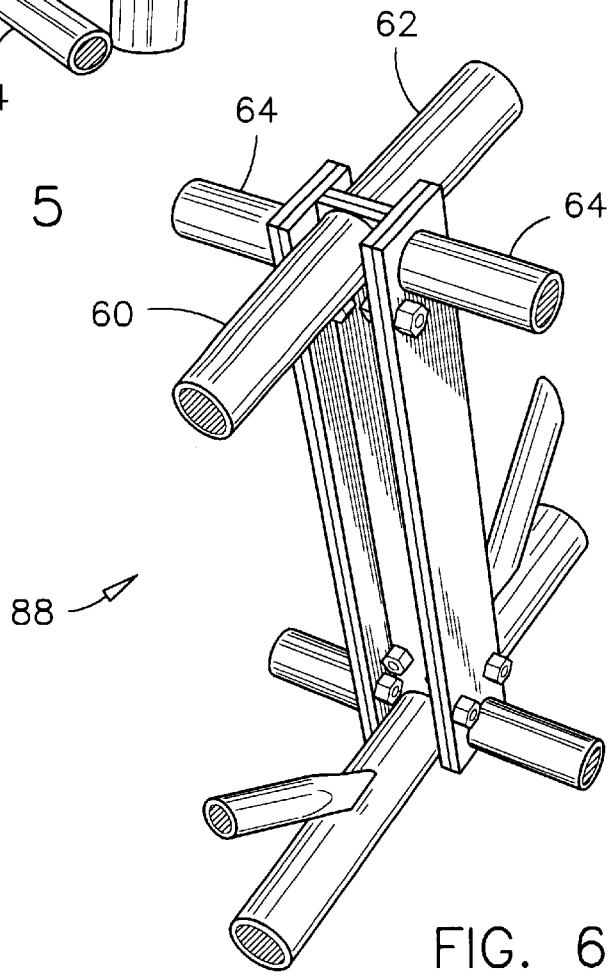
FIG. 6 is a perspective view of an alternate connection between an inner truss, an outer truss and ring trusses.

Referring back to FIG. 5, each inner truss 62 is connected to an outer truss 60 by means of a pair of third clevis and stem connections 84, only the upper one of the pair is illustrated in FIG. 5. Each ring truss 64 is connected to an outer truss 60 by a pair of a fourth type of clevis and stem connections 86. Alternatively, the trusses may be connected to each other by bolted connections 88, as illustrated in FIG. 6, according to the preference of the manufacturer.

Some of the clevis brackets 80 may have a modified shape 90, as illustrated in FIG. 7, to retain parallel trusses supporting a catwalk for example. The ring plate 70 also has a series of holes 92 therein to retain a clamping ring 94, for holding the flexible sheet sectors 38 to the ring plate 70, as illustrated in FIG. 8.

Figure 9:
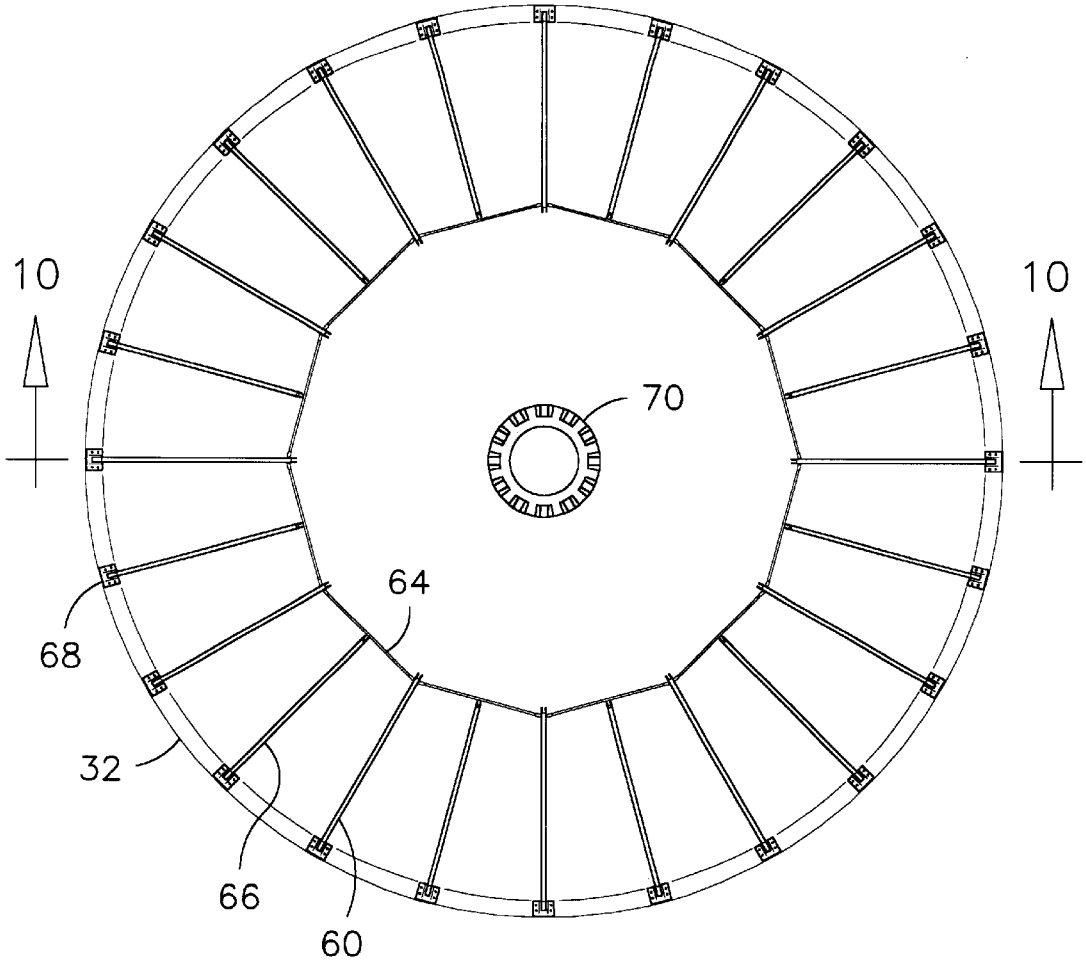
FIG. 9 a top view of a clarifier with the outer trusses and the ring trusses installed thereon.
Figure 10:
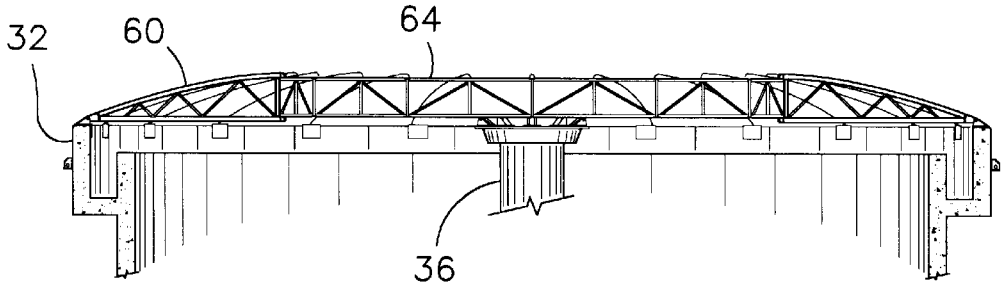
FIG. 10 is a cross-section view through the clarifier and the outer truss and ring truss assembly as seen along line 10—10 in FIG. 9.

Referring now to FIGS. 9 and 10, one of the most important feature of the present invention will be described. It will be appreciated that the assembly of the saddle brackets 68, the outer trusses 60, the intermediate trusses 66 and the ring trusses 64 constitute a self-supporting structure bearing entirely on the clarifier wall 32. In this structural assembly, the ring trusses 64 constitutes a compression ring that holds the outer trusses 60 and the intermediate trusses 66 above the clarifier wall. The inner trusses 62 as illustrated in FIGS. 1–3 are supported to the outer trusses 60 in an overhung mode. Therefore, it will be appreciated that the inner trusses 62 apply a minimum load on the central column 36 of the clarifier.

During the installation of the support structure, the saddle brackets 68 are preferably shimmed up or down as needed to reduce any stresses that may be applied to the central column 36. It is believed that the only load applied to the central column are generated by the deflection of the support structure under its own weight, under a snow load, a wind load, or by one or more imprecise connections between the trusses or along the side wall 32. A proper design and installation of the support structure can be done to take these factors into consideration such that the actual loading on the central column of the clarifier is considered minimal or negligible. This feature is particularly appreciable to accommodate the retrofit installation of a cover structure over an existing clarifier wherein the strength of the central column is not known precisely.

Figure 11:
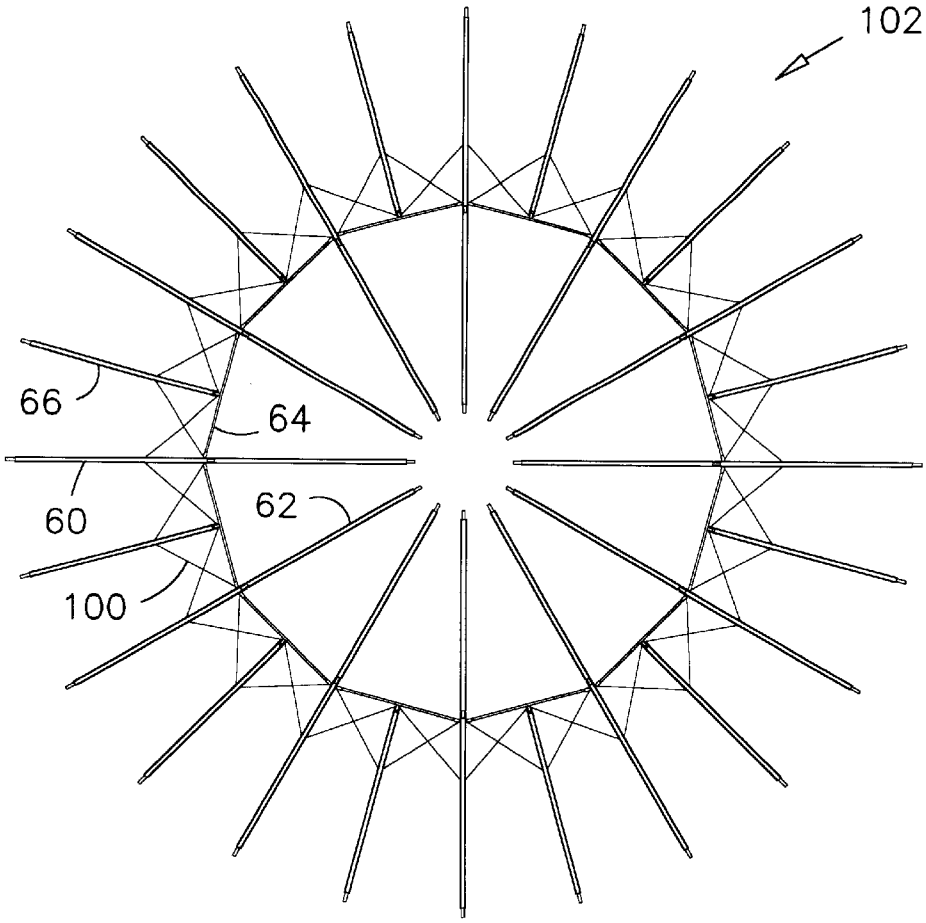
FIG. 11 is a top view of the support structure as optionally assembled on the ground, and in a condition to be hoisted over a clarifier.

Another important feature of the support structure according to the first preferred embodiment is that it can be assembled on the ground and lifted and transported over an existing clarifier with a crane. In these circumstances, an array of tie members 100, as illustrated in FIG. 11, are installed between the outer trusses 60, the intermediate trusses 66 and the ring trusses 64. The entire support structure 102 can then be lifted up with hoisting cables attached at three or more locations to the connections of the outer trusses 60 with the ring trusses 64 for example.

Figure 12:
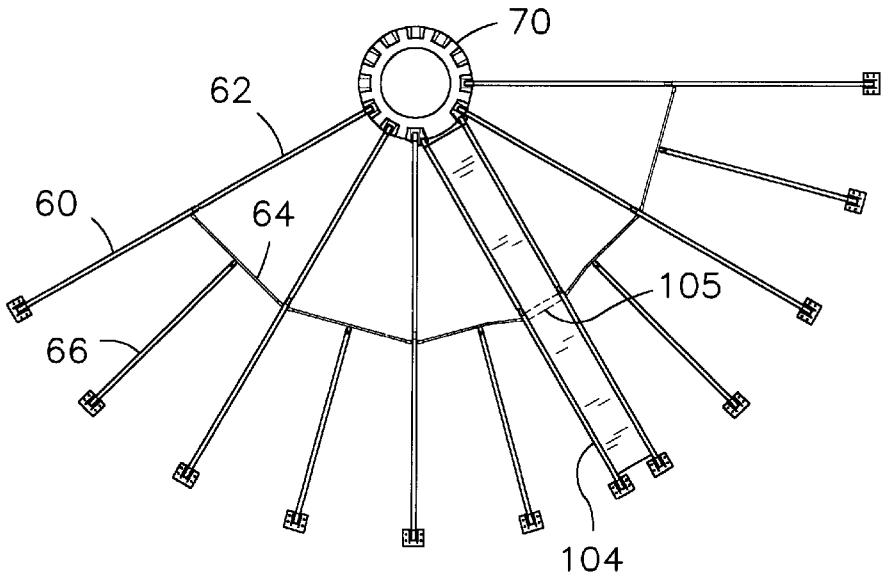
FIG. 12 is a partial top view of a support structure having a catwalk incorporated therein.
Figure 13:
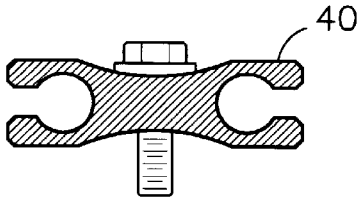
FIG. 13 is an enlarged cross-section view of a slotted rail mounted over the trusses of the support structure for retaining the sides of a flexible sheet sector to the trusses, as seen along line 13—13 in FIG. 16.
Figure 14:
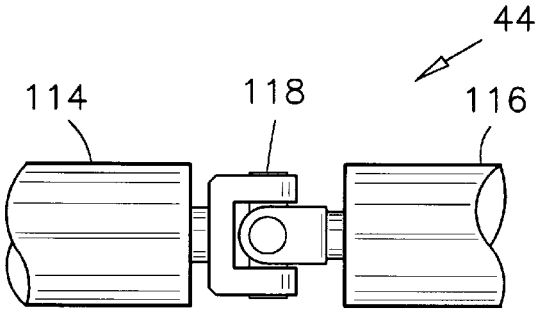
FIG. 14 is an enlarged partial view of a flexible joint between adjacent winding roll segments on a flexible sheet sector.
Figure 15:
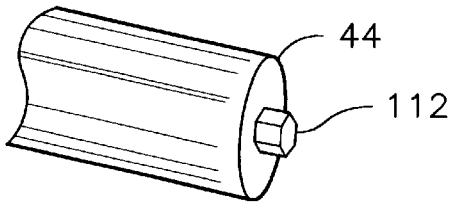
FIG. 15 is an enlarged partial view of an end of a winding roll on a flexible sheet sector.

When a catwalk 104 is installed in the cover structure 30, the ring trusses 64 on both sides of the catwalk 104 are linked together by a stiffening beam 105 extending below or across the floor of the catwalk as illustrated in FIG. 12, in order to maintain the integrity of the structural ring defined by the ring trusses 64.

Referring now to FIGS. 13–19 the attachment of a flexible sheet sector 38 over the support structure will be described. As mentioned earlier, each flexible sheet sector 38 is held to the outer trusses 60 and to the inner trusses 62 by means of slotted rails 40 affixed to the upper cord of the trusses. In a preferred installation over a clarifier having a launder portion 42, the slotted rails 40 do not extend to the edge of the clarifier. The retractable section 106 of a flexible sheet sector 38, is preferably immediately above the launder portion 42 and is held to the outer trusses 60 by rope lashings 108 through grommets (not shown) along both side edges of the retractable section 106. The rope lashings 108 are tied to a pair of edge support plates 110, affixed to the outer trusses 60 over the launder portion 42.

The retractable section 106 is held in a closed mode over the edge 46 of the clarifier wall 32 by a series of pullers 48 mounted in a structural angle 50 affixed to the clarifier wall 32, and pulling on a flexible winding roll 44. For opening the retractable portion 106 of a flexible sheet sector 38, the pullers 48 are disengaged from the winding roll 44, and the winding roll 44 is turned upon itself for winding the flexible sheet 38 thereon as illustrated in FIGS. 1 and 2. For this purpose, one end of the winding roll 44 has a drive stem 112 for connection to a rotating brace tool or to other socket drive equipment.

Figure 16:
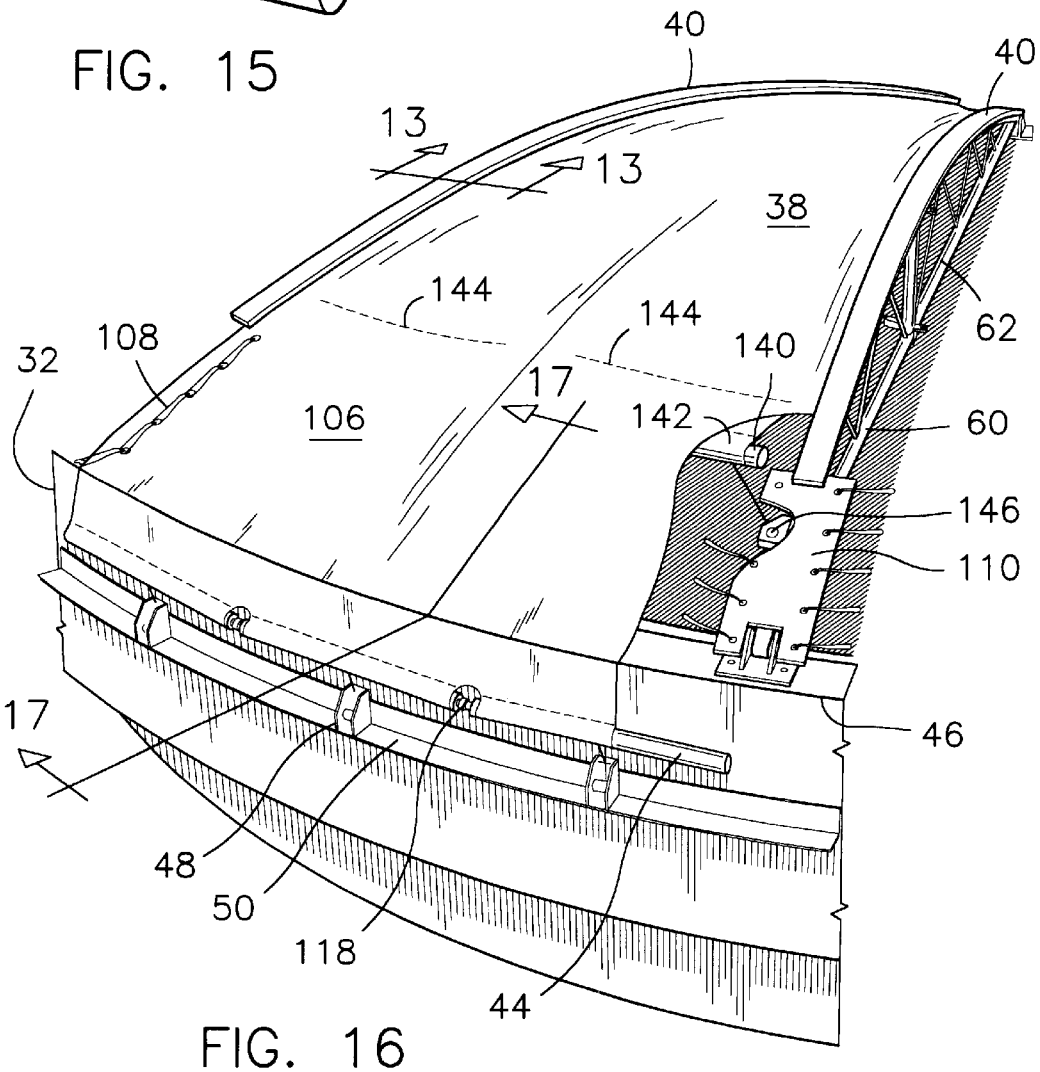
FIG. 16 is a partial perspective view of a clarifier and a retractable cover according to the first preferred embodiment of the present invention.

In the preferred embodiments, the winding roll 44 is made in two or more segments 114, 116 which are linked to each other by flexible torque-transmitting joints 118. The flexible winding roll 44 is thereby workable between a straight mode for rolling a sheet sector 38 thereon, and a curved mode to better seal the cover sector 38 against the edge 46 of the circular clarifier wall 32 as illustrated in FIG. 16. Although the preferred flexible roll 44 is illustrated herein with flexible torque-transmitting joints 118 it will be appreciated that it may also be made of a single section of flexible plastic pipe material for example.

Figure 18:
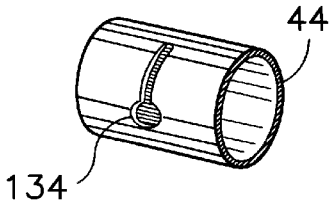
FIG. 18 is an enlarged partial view of a typical keyhole slot incorporated in a winding roll and in a sheet-stretching pipe.
Figure 19:
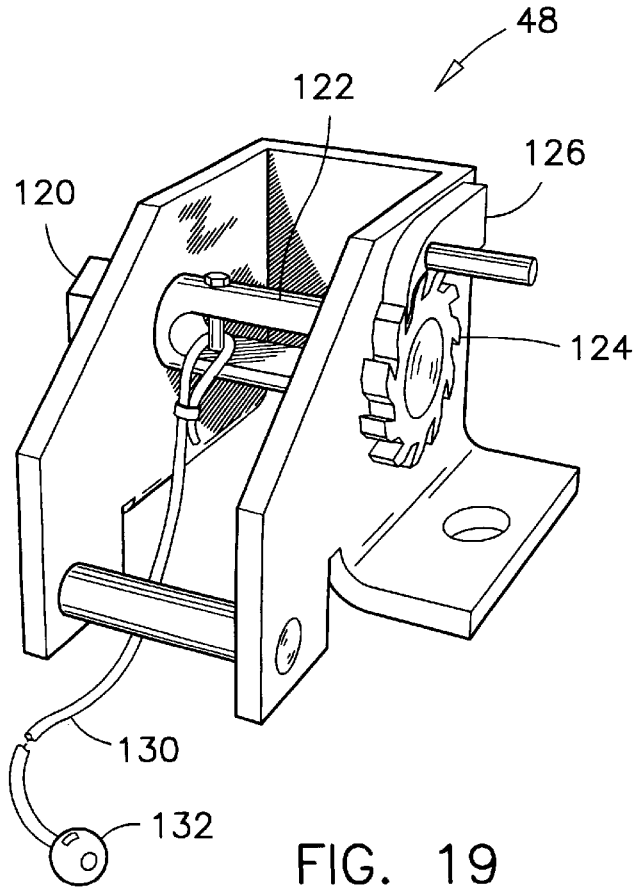
FIG. 19 is a perspective view of a preferred puller used for stretching the flexible sheet sectors over the support structure.

Referring now specifically to FIGS. 18 and 19, the preferred puller 48 has a faceted stem 120 for engagement with a socket drive tool. The stem is affixed to a winding shaft 122 to which is also affixed a ratchet wheel 124 on which a pawl 126 is engaged. The puller 48 further has a cable 130 affixed to the winding shaft, and a knob 132 crimped on the end of that cable. In use, the knob 132 is inserted into a keyhole slot 134 in a winding roll 44 and pulled toward the puller to stretch the flexible sheet sector over the edge 46 of the clarifier wall.

The structural angle 50 retaining the pullers 48 to the clarifier wall constitutes a guard rail for preventing damage to the retractable cover 30 or to the winding roll 44 by machinery moving near the clarifier wall 32.

Figure 17:
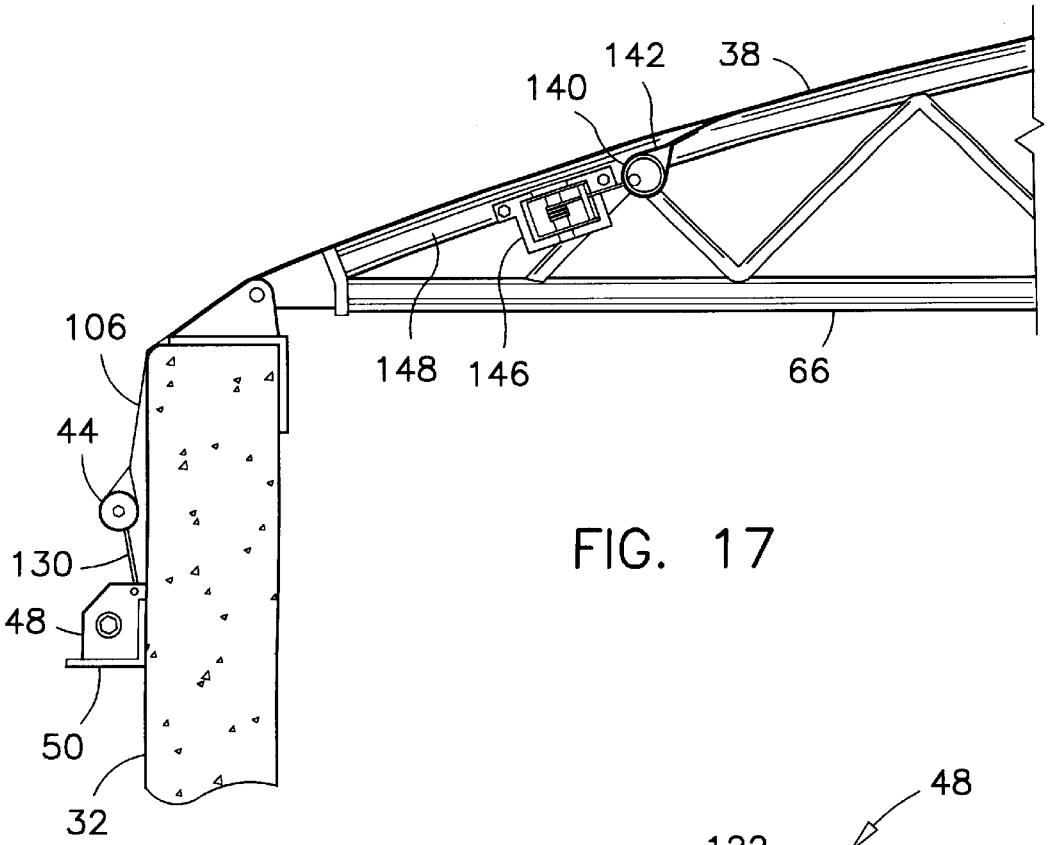
FIG. 17 is a partial cross-section view of a clarifier having a cover structure according to the first preferred embodiment mounted thereon, as seen along line 17—17 in FIG. 16.

Referring back particularly to FIGS. 16 and 17, another feature of the retractable cover 30 according to the first preferred embodiment is illustrated. The central portion of each flexible sheet sector 38 is held tightbetween adjacent inner trusses 62 and adjacent outer trusses 60, and toward the clarifier wall 32 by winches, in a similar manner as described for the retractable section 106. A pair of pipes 140 are held inside hems 142 which are affixed to the sheet sector 38 by stitches 144 or the like, adjacent the retractable section 106. The pipes 140 are pulled toward the clarifier wall 32 by winches 146, two of which are illustrated in FIGS. 16 and 17. The winches 146 are similar to the pullers 48 mounted on the clarifier wall 32. The winches 146 are affixed to the upper cord 148 of the outer trusses 60 and to the upper cord of the intermediate trusses 66. The winches 146 are detachably engaged with the pipes 140 by means of knobbed cables, as the one shown in FIG. 19

Figure 20:
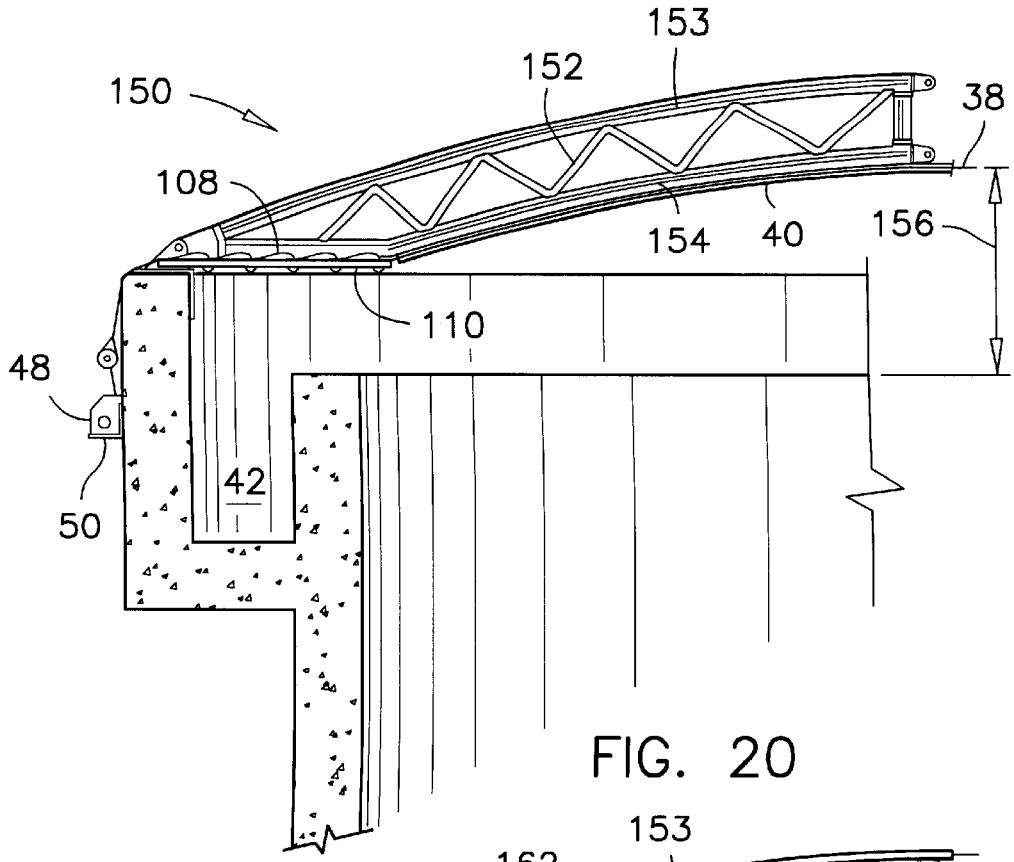
FIG. 20 is a partial cross-section view of a clarifier having a removable cover according to a second preferred embodiment mounted thereon.

In FIG. 20, there is illustrated a partial cross-section view of a retractable cover structure 150 according to the second preferred embodiment of the present invention. In this second preferred embodiment, have a curved lower cord 154. The slotted rails 40 are mounted under the lower cords 154 of the trusses, for holding the flexible sheet sectors 38 under the trusses 152. An edge plate 110 and rope lashing 108 are also used to retain each side edge of a retractable section of a sheet sector 38 to the trusses 152 over the launder portion 42 of a clarifier. In this embodiment, the space 156 between the maximum level of the clarifier and the cover is relatively small and therefore also relatively easy to ventilate. Moreover, the trusses 152 are kept outside the corrosive fumes that may be generated in some installations by the content of the clarifier.

Figure 21:
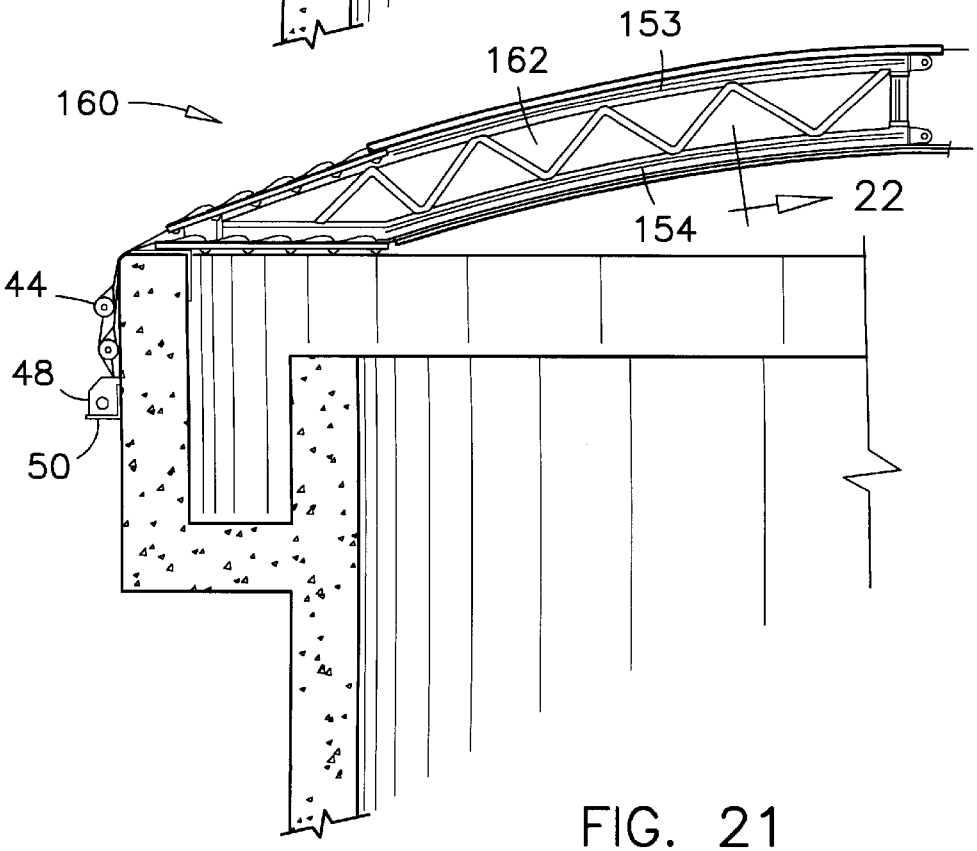
FIG. 21 is a partial cross-section view of a clarifier having a removable cover according to a third preferred embodiment mounted thereon.

It will be appreciated that the clarifier cover may comprise an inner flexible sheet as illustrated in FIG. 20, as well as an outer flexible sheet as described in the first preferred embodiment. This arrangement constitutes a third preferred embodiment 160 of the present invention, and is partly illustrated in FIG. 21. This arrangement is advantageous for combining the characteristics of the first and second preferred embodiments. The space 162 between the inner sheet and the outer sheet can be used as an air space to insulate the content of the clarifier against heat losses for example, or by circulating fresh air therein to prevent over-heating of the clarifier content from the sun's rays.

Where a flexible sheet sector 38 is hung under the trusses of a support structure, such as illustrated in FIGS. 20 and 21, and the structure of the clarifier cover is compatible to the joining of two or more flexible sheet sectors into a single sheet panel, an alternative to the slotted rail 40 may be used. Referring to FIG. 22, two or more flexible sheet sectors 38 may be joined to form a single sheet panel 164 that is hung to a slotted pipe 166 affixed to the lower cord 154 of a truss. In this mounting, a strip of fabric 168 is wrapped and sewn over a rope, a flexible cord, a rubber hose 170 or the like, and bent outwardly to form opposite flaps 172. The flaps are bonded or otherwise affixed to the sheet panel 164. The covered rope, cord or hose 170 is inserted in the slotted pipe 166. The flexible sheet panel is thereby removable from the trusses if the need arises.

Where the material of the slotted pipe is different from the material of the truss and welding is not appropriate to affix the slotted pipe to the truss, the slotted pipe 166 may be affixed to the truss with self-tapping screws 174, rivets or other similar fasteners, as shown in FIGS. 23 and 24. When a power tool is used to install the fasteners, the slot 176 may have an enlarged region 178 at each fastener to accommodate for the tip of the power tool.

As can be seen from the illustration in FIG. 23, the slotted pipe 166 can be affixed to the truss in any position, such as alongside one of the cord 154 of the truss. This arrangement is a preferred alternative to the slotted rail 40, to retain the flexible sheet sectors to both handrails or to the floor joists of a catwalk 104 for example.

In a fourth preferred embodiment 180 of the present invention, the retractable section 182 of the cover is disposed along a vertical wall of a raised-roof clarifier cover. This arrangement is advantageous for obtaining access to large equipment near the perimeter of a clarifier, or to let an excavator or other machinery reach inside the cover support structure.

Referring now to FIGS. 25 and 26, the principal features of the clarifier cover according to the fourth preferred embodiment are illustrated therein. The flexible sheet sectors extending over the roof trusses 184 are held to the trusses in slotted rails 40 as previously explained. The retractable section 182 of the cover is detachably held to the wall columns 186 by rope lashings 108 extending through edge plates 110 also as previously described. The retractable section 182 is held in a closed mode by pullers 48 and is rollable upwardly over a winding roll 44.

In this embodiment, a rounded cornice 190 is mounted to the roof trusses 184 and defines an eave 192 under the roof trusses 184. In this embodiment, the roof portion 188 of the cover is not continuous with the retractable section 182. The retractable section 182 is anchored to the rounded cornice 190 and hangs down along the wall columns 186. The roof portion 188 extends down just enough to wrap around the rounded cornice 190, and carries at its lower edge one or more lengths of roof-stretching pipe 194. These lengths of roof-stretching pipe 194 and the roof portion 188 are pulled around the rounded cornice 190 by a series of pullers 146 mounted to the cover support structure. The pullers' cables 130 extend through the retractable section 182 and are attached to the lengths of pipe 194, in keyhole slots through the pipe walls as previously explained.

The working of the pullers 146 causes the pipes 194 to simultaneously stretch the roof portion 188 and pull the upper portion of the retractable section 182 inside the eave 192, to define a soft and a drip edge of that eave. This arrangement is advantageous for allowing rainwater 196 to drip away from the edge plates 110, and falling snow to accumulate away from the wall columns 186.

A removable cover according to one of the preferred embodiments mounted over a clarifier, has been found to be resistant, durable and sufficiently strong to permit one of more workers to walk thereon for the purpose of fixing it if the need arises.

As to other manners of construction, installation and operation of the present invention, the same should be apparent from the above description and accompanying drawings and accordingly further discussion relative to these aspects would be considered redundant and is not provided. It will also be appreciated that many changes and modifications may be made to the illustrated and described embodiments without departing from the essence of this invention. Therefore, the above description and illustrations should not be construed as limiting the scope of the invention which is defined by the appended claims.

I claim:

1. In combination, a clarifier and a cover mounted over said clarifier for retaining off-gases inside said clarifier; said clarifier having a circular outside wall and a central column mounted therein, and said cover comprising:

an array of radial trusses each having an arc shape having a maximum height at an intermediate region thereof and minimum heights at both ends thereof, said both ends being mounted to said circular outside wall and to said central column respectively, and a cover affixed to said array of radial trusses;

such that a volume of gas contained under said cover is small, and a ventilation of said volume of gas is economically doable.

2. The combination as claimed in claim 1, wherein said clarifier further has a central ring plate mounted on said central column and a plurality of saddle brackets mounted on said circular outside wall, and said array of radial trusses further comprises:

a plurality of ring trusses defining a circle concentric with, and disposed inside said circular outside wall;

a radial array of outer trusses each having an outside end mounted to one of said saddle brackets and an inside end mounted to said plurality of ring trusses, and a plurality of inner trusses individually affixed to and extending from said inside end of one of said outer trusses, toward said central column.

3. The combination as claimed in claim 2, wherein each of said outer trusses being affixed to one of said saddle brackets by means of a first clevis and stem connection, and each of said inner trusses being affixed to said central ring plate by means of a second clevis and stem connection.

4. The combination as claimed in claim 2, wherein said array of radial trusses also comprises a catwalk extending between said circular outside wall and said central column.

5. The combination as claimed in claim 2, wherein each of said inner trusses has an upper cord and a lower cord, and said cover is affixed to said lower cords.

6. A clarifier cover for retaining off-gases inside a clarifier, comprising:

a support structure having;

a circular shape, a centre and a circumference;

an array of triangular frame sectors, each having an apex near said centre and a base near said circumference;

a plurality of flexible sheet sectors affixed to said triangular frame sectors and at least one of which having a retractable section near said base of one of said triangular frame sector; said retractable section being removably affixed to one of said triangular frame sectors;

such that said retractable section is selectively openable for inspection of a clarifier covered by said clarifier cover.

7. The clarifier cover as claimed in claim 6, wherein said support structure further comprises:

a plurality of spaced-apart saddle brackets affixed thereto along said circumference, and a central ring plate affixed thereto around said centre;

a plurality of ring trusses disposed in a circular array and defining a circle, concentric with and inside said circumference;

a radial array of outer trusses each having an outside end mounted to one of said saddle brackets and an inside end mounted to said plurality of ring trusses, and a plurality of inner trusses individually affixed to and extending from said inside end of one of said outer trusses, toward said centre of said circular shape.

8. The clarifier cover as claimed in claim 7, wherein each of said outer trusses is affixed to one of said saddle brackets by means of a first clevis and stem connection, and each of said inner trusses is affixed to said central ring plate by means of a second clevis and stem connection.

9. The clarifier cover as claimed in claim 7, further comprising a plurality of intermediate trusses respectively mounted to one of said saddle brackets and to one of said ring trusses between two adjacent said outer trusses.

10. The clarifier cover as claimed in claim 7, wherein said circle is about midway between said circumference and said centre.

11. In combination, a clarifier and a retractable cover mounted over said clarifier for retaining off-gases inside said clarifier; said clarifier having a circular outside wall and a central column, and said retractable cover comprising:

a central ring plate mounted on said central column;

a plurality of saddle brackets mounted on said circular outside wall;

a support structure affixed to said plurality of support brackets and to said central ring plate, said support structure comprising:

an array of triangular frame sectors, each having an apex near said central column and a base near said circular outside wall;

a plurality of flexible sheet sectors, each of which being affixed to one of said triangular frame sectors and at least one of which having a retractable section near said base of one of said triangular frame sector; said retractable section being removably affixed to one of said triangular frame sectors and to said circular outside wall;

such that said retractable cover is selectively openable for inspection of said clarifier.

12. The combination as claimed in claim 11 wherein each of said flexible sheet sectors is made of a stretch-resistant nylon-based pliable sheet material.

13. The combination as claimed in claim 11, wherein said clarifier has a launder near said circular outside wall and said retractable section is disposed above said launder.

14. The combination as claimed in claim 11, wherein at least one of said triangular frame sectors comprises a pair of support plates affixed thereto under said retractable section of said flexible sheet sector, and said retractable section is detachably held to said support plates by rope lashings through said support plates.

15. The combination as claimed in claim 13, wherein said retractable section comprises a winding roll affixed thereto and said retractable section is rollable over said winding roll.

16. The combination as claimed in claim 15, wherein said winding roll comprises several segments joined to each other by flexible torque-transmitting joints.

17. The combination as claimed in claim 16, further comprising a plurality of pullers mounted on said circular outside wall and having means for pulling said retractable section over said circular outside wall.

18. The combination as claimed in claim 17, wherein said plurality of pullers are mounted in a structural angle extending around said circular outside wall.

19. The combination as claimed in claim 17, wherein said means for pulling said retractable section over said circular outside wall comprises cables between said winding roll and said pullers.

20. The combination as claimed in claim 19, wherein each of said cables has a knob crimped thereon, and said winding roll has keyhole slots therein for detachably retaining said knobs.

21. The combination as claimed in claim 11, wherein each said flexible sheet sector comprises a central portion and a pair of pipes enclosed in hems affixed to said central portion, and said central portion is held tight between said outer and inner trusses by winches affixed to one of said triangular frame sectors and connected to said pipes.

* * * * *